US006345394B1

(12) United States Patent
Nakamura et al.

(10) Patent No.: US 6,345,394 B1
(45) Date of Patent: Feb. 12, 2002

(54) RUBBER GLOVE AND PROCESS FOR PRODUCING SAME

(75) Inventors: Misao Nakamura; Toshihiro Inoue, both of Kawasaki (JP)

(73) Assignee: Zeon Corporation, Tokyo (JP)

( * ) Notice: Subject to any disclaimer, the term of this patent is extended or adjusted under 35 U.S.C. 154(b) by 0 days.

(21) Appl. No.: 09/891,385

(22) Filed: Jun. 27, 2001

(30) Foreign Application Priority Data

Jun. 29, 2000 (JP) ..... 2000-196240

(51) Int. Cl.[7] ..... A41D 19/00
(52) U.S. Cl. ..... 2/168; 2/159; 2/164; 2/161.7
(58) Field of Search ..... 2/159, 164, 167, 2/165, 169

(56) References Cited

U.S. PATENT DOCUMENTS 3,761,965 A * 10/1973 Barasch ..... 2/159
4,070,713 A 1/1978 Stockum
4,578,826 A * 4/1986 Adiletta ..... 2/167
5,570,475 A * 11/1996 Nile et al. ..... 2/161.7
6,016,570 A * 1/2000 Vande Pol et al. ..... 2/161.7

* cited by examiner

*Primary Examiner*—John J. Calvert
*Assistant Examiner*—Robert H. Muromoto
(74) *Attorney, Agent, or Firm*—Armstrong, Westerman, Hattori, McLeland & Naughton, LLP

(57) ABSTRACT

A rubber glove comprising a main rubber layer and an inner covering layer, bonded to the main rubber layer, containing resin particles is disclosed. The resin particles are partially exposed on the skin-contacting surface of the inner covering layer to an extent such that, among resin particles visually observed in unit area of the skin-contacting surface, resin particles having a maximum particle diameter of 2–20 $\mu$m have a total projected area ratio A of 5–50%, as defined by the formula: $A(\%)=B/C\times100$, where B is total projected area of resin particles with a maximum particle diameter of 2–20 $\mu$m, and C is the unit area. The rubber glove can be easily donned and pulled off, and resin particles do not fall or do fall off only to a very slight extent upon donning or pulling off, and, when the inner covering layer is placed in contact with each other, the layer does not easily stick to each other.

10 Claims, No Drawings

RUBBER GLOVE AND PROCESS FOR PRODUCING SAME

BACKGROUND OF THE INVENTION (1) Field of the Invention

This invention relates to a rubber glove and a process for producing the rubber glove.

The rubber glove of the present invention has an inner covering layer, bonded to a main rubber layer of the rubber glove, which inner covering layer contains resin particles partially exposed on the skin-contacting surface thereof. This rubber glove can be easily donned and put off by the partially exposed resin particles, which do not easily fall off or do fall off only to a very slight extent when the rubber glove is donned or pulled off, and, when the inner covering layer is placed in contact with each other, the layer does not easily stick to each other.

(2) Description of the Related Art

The surfaces of rubber gloves made of natural rubber or synthetic rubber are sticky and not slippery. Especially when the skin-contacting inner surface of a rubber glove is not slippery, the glove cannot be easily donned and put off. To facilitate donning and putting off of the glove, a loose dusting powder is applied onto the skin-contacting inner surface. However, the applied dusting powder easily falls of f upon donning or putting off the glove or during the use thereof, and, when the glove is used in a medical field including surgery, the falling dusting powder may contaminate an operated part and cause postoperative complications.

A proposal has been made wherein the skin-contacting inner surface of a glove is subjected to a chlorination treatment to form protrusions thereon making it slippery. This proposal has problems such that the treating process is difficult to control, the donning and putting-off properties cannot be enhanced to the desired extent, and the use of chlorine may cause environmental pollution.

Another proposal has been made wherein a slippery inner layer comprising a lubricant and a binder is formed on the skin-contacting surface of a rubber glove. In contrast to the powdered rubber glove wherein a loose dusting powder is physically adsorbed on the inner surface thereof, a rubber glove having the inner slippery layer has a benefit such that the inner slippery layer is bonded to the inner surface of the glove by a binder and thus, the lubricant does not easily fall off. For example, a medical rubber glove has been proposed in U.S. Pat. No. 4,070,713, which has an inner lubricating layer formed from a latex of carboxylated styrene-butadiene rubber having dispersed therein starch. A rubber glove has been proposed in Japanese Unexamined Patent Publication (hereinafter abbreviated to "JP-A") No. H11-61527, which has an inner lubricating layer prepared from an aqueous dispersion comprising a synthetic rubber latex, which is incapable of being coagulated with a coagulant contained in a main rubber layer of the rubber glove, said rubber latex being blended with an organic filler such as a crosslinkable polymethyl methacrylate. These proposals provide an improvement in the donning and putting-off properties, but, the improvement achieved is still not to the desired extent. Further, adhesion of the lubricant used, i.e., starch or an organic filler such as a crosslinked polymethyl methacrylate to an elastomer formed by drying of the rubber latex, is weak and thus, the lubricant tends to fall off.

Another rubber glove has been proposed in JP-A H8-294, 930 which is made by a process comprising dipping a glove form in a rubber latex formulation to form a first rubber layer on the glove form, and then, dipping the glove form having the first rubber layer in a rubber latex formulation comprising finely divided particles of a thermoplastic resin such as an ethylene-acrylic acid copolymer resin, a rubber latex, and a blocked isocyanate, to form a second rubber layer, which constitutes an inner lubricating resin particle-containing layer of the rubber glove. By the use of a blocked isocyanate, adhesion of the thermoplastic resin particles to an elastomer derived from the rubber latex is enhanced, but, adhesion of the second rubber layer, i.e., the inner lubricating resin particle-containing layer, to the first rubber layer is poor and thus, the inner lubricating resin particle-containing layer tends to be separated from the first rubber layer.

SUMMARY OF THE INVENTION

In view of the foregoing prior art, a primary object of the present invention is to provide a rubber glove having an inner layer containing resin particles partially exposed on the skin-contacting surface thereof, which glove can easily be donned and put off, and the resin particles contained in the inner layer do not fall off, or do fall only to a very slight extent when the glove is donned or put off, and, when the inner resin particle-containing layer is placed in contact with each other, the layer does not easily stick to each other.

In accordance with the present invention, there is provided a rubber glove comprising a main rubber layer and an inner covering layer, bonded to the main rubber layer, said inner covering layer being formed from a coating composition comprising a polymer latex and resin particles dispersed in the polymer latex; said resin particles being partially exposed on the skin-contacting surface of the inner covering layer to an extent such that, among resin particles visually observed in unit area of the skin-contacting surface of the inner covering layer, resin particles having a maximum particle diameter in the range of 2 to 20 $\mu$m have a total projected area ratio A in the range of 5% to 50%, as defined by the following formula (1):

Total projected area ratio $A(\%)=B/C\times100$ (1)

where B is total projected area of the resin particles with a maximum particle diameter of 2 to 20 $\mu$m, and C is the unit area.

In accordance with the present invention, there is further provided a process for producing a rubber glove comprising a main rubber layer and an inner covering layer, bonded to the main rubber layer, which comprises the step of coating one surface of a rubber glove having a main rubber layer, with a coating composition comprising a polymer latex and resin particles dispersed in the polymer latex, to form a resin particle-containing inner covering layer on the surface of the rubber glove; the thus-formed inner covering layer having the resin particles, which are partially exposed on the skin-contacting surface of the inner covering layer to an extent such that the above-mentioned total projected area ratio A of the resin particles, represented by the formula (1), is satisfied.

DESCRIPTION OF THE PREFERRED EMBODIMENTS

The rubber glove of the present invention comprises a main rubber layer constituting the glove proper, and an inner covering layer, bonded to the main rubber layer. The inner covering layer is formed from a coating composition comprising a polymer latex and resin particles dispersed in the polymer latex.

The method for forming the main rubber layer constituting the glove proper is not particularly limited, and the main rubber layer is formed from natural rubber latex, synthetic rubber latex, or a mixed rubber latex thereof by conventional dip-forming methods which include, for example, straight dipping, coagulation dipping and dry heat dipping.

The thickness of the inner covering layer is not particularly limited, but it is preferably in the range of 0.1 am and 10 μm. When the thickness is smaller than 0.1 μm, resin particles tend to fall off from the inner covering layer. In contrast, when the thickness is larger than 10 μm, resin particles are liable to be buried within the inner covering layer, and thus, the donning and putting-off of the glove become difficult and the inner covering layer readily sticks to each other. By the term "thickness of the inner covering layer" used herein, we mean the thickness as measured at a part of the inner covering layer, in which part resin particles are not exposed on the skin-contact surface thereof, and which part is predominantly comprised of a polymer latex.

The resin constituting resin particles contained in the inner covering layer usually has a glass transition temperature of 30 to 120° C., preferably 40 to 100° C. If the glass transition temperature is too low, the rubber glove cannot easily be donned or put off, and the inner covering layer is liable to stick to each other. In contrast, if the glass transition temperature is too high, resin particles tend to fall off in a salient amount.

The resin particles contain 0 to 60% by weight, preferably 0 to 40% by weight, based on the weight of the resin particles, of toluene-insoluble matter. When the content of toluene-insoluble matter in the resin particles is too large, the resin particles tend to fall off in a salient.

The resin particles usually have a volume average particle diameter of 1 to 50 μm, preferably 1 to 30 μm, and more preferably 2 to 10 μm. If the volume average particle diameter is smaller than 1 μm, the rubber glove cannot easily be donned or put off. In contrast, if the volume average particle diameter is larger than 50 μm, the rubber glove becomes rough to the touch and uncomfortable.

The shape of the resin particles is not particularly limited, but, a spherical form is most preferable because the glove becomes soft to the touch when donned, and load imposed to individual particles upon donning is reduced and falling off thereof can be minimized.

As specific examples of the resin particles, there can be mentioned resin particles of an acrylic acid ester polymer, a methacrylic acid ester polymer, a styrene-acrylic acid ester copolymer, a styrene-methacrylic acid ester copolymer, polyurethane, polyamide, an olefin polymer, a vinyl chloride polymer, a vinylidene chloride polymer and cellulose derivatives such as nitrocellulose, cellulose acetate, cellulose acetate butyrate, cellulose propionate and ethyl cellulose. These resins may be used either alone or in combination.

Of these resin particles, resin particles of an acrylic acid ester polymer, a methacrylic acid ester polymer, a styrene-acrylic acid ester copolymer and a styrene-methacrylic acid ester copolymer are preferable because a glass transition temperature can be freely designed for these polymer resin particles.

The styrene-acrylic acid ester copolymer and the styrene-methacrylic acid ester copolymer are copolymers comprising styrene units, and acrylic acid ester units or methacrylic acid ester units, and optionally further comprising crosslinking monomer units.

The amount of styrene units is usually in the range of 60 to 95% by weight, preferably 65 to 90% by weight, based on the total monomer units. If the amount of styrene units is too small, the inner covering layer of a rubber glove tends to stick to each other. In contrast, if the amount of styrene units is too large, resin particles are liable to fall off.

The acrylic acid ester and the methacrylic acid ester are not particularly limited, but preferably include alkyl esters of acrylic acid and alkyl esters of methacrylic acid, the alkyl group of which has 1 to 10 carbon atoms. Specific examples of the acrylic acid ester and the methacrylic acid ester, there can be mentioned methyl acrylate, ethyl acrylate, propyl acrylate, butyl acrylate and 2-ethylhexyl acrylate; and methyl methacrylate, ethyl methacrylate, propyl methacrylate, butyl methacrylate and 2-ethylhexyl methacrylate. The alkyl group in the alkyl esters may have a substituent such as a hydroxyl group, an alkoxy group, e.g., a methoxy group, and an epoxy ring. As examples of the acrylic acid ester and methacrylic acid ester having a substituent, there can be mentioned alkoxyalkyl esters such as methoxymethyl acrylate and methoxymethyl methacrylate, hydroxyalkyl esters such as 2-hydroxyethyl acrylate and 2-hydroxyethyl methacrylate, and epoxy ring-containing esters such as glycidyl acrylate and glycidyl methacrylate. The acrylic acid ester and the methacrylic acid ester may have a substituent such as, for example, halogen.

The amount of acrylic acid ester or methacrylic acid ester units is usually in the range of 5 to 50% by weight, preferably 10 to 45% by weight, based on the total monomer units. If the amount of acrylic acid ester or methacrylic acid ester units is too small, resin particles are liable to fall off. In contrast, if the amount of acrylic acid ester or methacrylic acid ester units is too large, a glove becomes difficult to don and put off, and the inner covering layer of the rubber glove tends to stick to each other.

The crosslinking monomer optionally used is a polyfunctional monomer which includes, for example, divinylbenzene, polyethylene glycol diacrylate, polyethylene glycol dimethacrylate, polypropylene glycol diacrylate, polypropylene glycol dimethacrylate, trimethylolpropane triacrylate, trimethylolpropane trimethacrylate, pentaerythritol acrylate and pentaerythritol methacrylate.

The amount of crosslinking monomer units is usually in the range of 0 to 2% by weight, preferably 0 to 1% by weight, based on the total monomer units. If the amount of crosslinking monomer units is too large, resin particles are liable to fall off.

The acrylic acid ester polymer and methacrylic acid ester polymer are polymers comprising acrylic acid ester or methacrylic acid ester units, and optionally crosslinking monomer units. As specific examples of the acrylic acid ester and the methacrylic acid ester, there can be mentioned those which are recited above as for the styrene-acrylic acid ester copolymer and the styrene-methacrylic acid ester copolymer. The acrylic acid ester and methacrylic acid ester may be used either alone or in combination.

The amount of acrylic acid ester or methacrylic acid ester units in the acrylic acid ester polymer or methacrylic acid ester polymer is preferably in the range of 98 to 100% by weight, preferably 99 to 100% by weight, based on the total monomer units. In the case where two or more kinds of acrylic acid esters and/or methacrylic acid esters are used, the kinds and amounts thereof can appropriately be chosen so that a copolymer having a desired glass transition temperature is obtained.

As specific examples of the crosslinking monomer optionally used for the preparation of the acrylic acid ester polymer and the methacrylic acid ester polymer, there can be mentioned those which are recited above as for the styrene-acrylic acid ester copolymer and the styrene-methacrylic acid ester copolymer. The amounts of the crosslinking monomer units optionally contained in the acrylic acid ester polymer or methacrylic acid ester polymer is preferably in the range of 0 to 2% by weight, preferably 0 to 1% by weight, based on the total monomer units.

The polymerization procedure for the production of resin particles is not particularly limited. When an emulsion or suspension polymerization is carried out in an aqueous medium, an aqueous dispersion of resin particles is directly obtained. When a bulk or solution polymerization is carried out, resin particle can be obtained by removing a liquid medium and an unreacted monomer from the polymerization mixture and then pulverizing the polymer into particles.

The polymer latex used for the coating composition comprises a polymer having a glass transition temperature in the range of −50 to +20° C., preferably −40 to 0° C. If the glass transition temperature is lower than −50° C., the rubber glove is difficult to don and put off, and the inner covering layer tends to stick to each other. In contrast, if the glass transition temperature is higher than +20° C., when the rubber glove is pulled, cracks are liable to occur in the inner covering layer and the inner covering layer tends to be separated from the main rubber layer.

The polymer in the latex usually has an average volume particle diameter in the range of 0.01 to 5 μm, preferably 0.03 to 2 μm. If the volume average particle diameter is smaller than 0.01 μm, an as-polymerized polymer latex has a high viscosity and is difficult to handle. In contrast, if the volume average particle diameter is larger than 5 μm, the inner covering layer is not uniform and the resin particles tend to fall off.

As specific examples of the polymer in the latex for the coating composition, there can be mentioned a styrene-butadiene copolymer, an acrylonitrile-butadiene copolymer, an acrylic acid ester polymer and a methacrylic acid ester polymer. Of these, an acrylic acid ester polymer and a methacrylic acid ester polymer are preferable because these polymers exhibit high adhesion to the resin particles and thus, the resin particles do not fall off or do fall off only to a very slight extent.

The acrylic acid ester polymer and the methacrylic acid ester polymer comprise acrylic acid ester monomer units and/or methacrylic acid ester monomer units, and optional units of a copolymerizable ethylenically unsaturated monomer or monomers. As specific examples of the acrylic acid ester monomer and the methacrylic acid ester monomer, there can be mentioned those which are recited above as for resin particles. As specific examples of the optionally used ethylenically unsaturated monomer, there can be mentioned aromatic vinyl monomers such as styrene and α-methylstyrene, α,β-ethylenically unsaturated carboxylic acids such as acrylic acid, methacrylic acid, maleic acid, fumaric acid and monobutyl fumarate, and conjugated diene monomers such as butadiene and isoprene. Acrylate ester polymer and methacrylate ester polymer, having copolymerized therewith 0.1 to 5% by weight of an α,β-ethylenically unsaturated carboxylic acid, especially methacrylic acid, is preferable.

The polymer latex used for the coating composition can be produced by a conventional emulsion polymerization procedure conducted in an aqueous medium by using a dispersion stabilizer, a polymerization initiator and other optional polymerization auxiliaries.

The dispersion stabilizer used is not particularly limited, but, a water-soluble polymeric material is preferably used because undesirable sticking of the inner covering layer can be avoided or minimized.

As specific examples of the polymeric material, there can be mentioned polyvinyl alcohol and modified products thereof; hydrolyzed products of copolymers of vinyl acetate with acrylic acid, methacrylic acid or maleic anhydride; neutralized products of copolymers of an ethylenically unsaturated carboxylic acid monomer with other copolymerizable ethylenically unsaturated monomer; cellulose derivatives such as alkyl cellulose, hydroxyalkyl cellulose and carboxymethyl cellulose; starch derivatives such as alkyl starch, carboxymethyl starch and oxidized starch; gum arabic and tragacanth gum; and polyalkylene glycol. Of these, polyvinyl alcohol and its modified products, and neutralized products of copolymers of an ethylenically unsaturated carboxylic acid monomer with other copolymerizable ethylenically unsaturated monomer are preferable because products having good quality are commercially readily available and products having desired properties can be easily designed.

The water-soluble polymeric material usually has a weight average molecular weight (Mw) in the range of 1,000 to 500,000, preferably 2,000 to 300,000. A polymeric material with Mw of smaller than 1,000 leads to reduction of dispersion stability. In contrast, a polymeric material with Mw of larger than 500,000 is difficult to prepare because its viscosity during polymerization is very high.

The polymerization initiator is not particularly limited, but, a water-soluble peroxide, especially a persulfate salt is preferably used because a polymer latex with enhanced stability is obtained.

The proportion of the resin particles to the polymer latex in the coating composition is not particularly limited, but, the amount of resin particles in the coating composition is usually in the range of 20 to 300 parts by weight, preferably 30 to 200 parts by weight, and more preferably 50 to 180 parts by weight, based on 100 parts by weight of the solid content of the polymer latex. If the amount of resin particles is too small, the rubber glove becomes difficult to don and put off. In contrast, if the amount of resin particles is too large, the inner covering layer becomes rigid and resin particles are liable to fall off.

The coating composition is prepared by blending a polymer latex and an aqueous dispersion of resin particles.

The coating composition usually has a solid content of 0.1 to 20% by weight, preferably 1 to 15% by weight, based on the coating composition. If the solid content is smaller than 0.1% by weight, the inner covering layer becomes thin and resin particles tend to fall off. In contrast, if the solid content is larger than 20% by weight, the inner covering layer becomes thick and resin particles are buried therein, and thus, the glove becomes difficult to don and put off, and the inner covering layer tends to stick to each other.

The coating composition usually has a viscosity in the range of 1 to 500 Pa·s, preferably 1 to 200 Pa·s. If the viscosity is smaller than 1 Pa·s, the inner covering layer formed becomes thin and resin particles tend to fall off. In contrast, if the viscosity is larger than 500 Pa·s, the inner covering layer becomes thick and resin particles are buried therein, and thus, the glove becomes difficult to don and put off, and the inner covering layer tends to stick to each other.

Additives such as a thickener, a wetting agent, an antifoamer, a pH adjuster and an antioxidant can be added to the coating composition according to the need. If desired, a hydrophilic liquid medium such as alcohols, cellosolves, glycols and glycerin can be added to enhance drying property and film-forming property.

The rubber glove of the present invention is made by a process wherein a glove form is dipped in a rubber latex to form a main rubber layer on the glove form; and one surface of a rubber glove having the main rubber layer is coated with a coating composition comprising a polymer latex and resin particles dispersed in the polymer latex, to form an inner resin particle-containing covering layer on the surface of the rubber glove. The procedure of coating one surface of the rubber glove is not particularly limited, and includes, for example, a procedure of dipping the rubber glove in the coating composition, and a procedure of coating the rubber glove with the coating composition by a brush or other coater.

The coating of the coating composition for forming the inner covering layer may be conducted either subsequently to the formation of the main rubber layer on a glove form, or on a separately made rubber glove. After coating of the rubber glove having the main rubber layer with the coating composition for the formation of the inner covering layer, the coating applied is dried to give a rubber glove of the present invention.

The inner covering layer, bonded to the main rubber layer, of the rubber glove of the present invention is characterized in that resin particles are partially exposed on the skin-contacting surface of the inner covering layer to an extent such that, among resin particles visually observed in unit area of the skin-contacting surface of the inner layer, resin particles having a maximum particle diameter in the range of 2 to 20 $\mu$m have a total projected area ratio A in the range of 5% to 50%, as defined by the following formula (1):

Total projected area ratio $A(\%)=B/C\times 100$ (1)

where B is total projected area of the resin particles with a maximum particle diameter of 2 to 20 $\mu$m, and C is the unit area.

The total projected area ratio A is preferably in the range of 10 to 40%, more preferably 15 to 38%. If the total projected area is smaller than 5%, the rubber glove is difficult to don and put off, and the inner covering layer is liable to stick to each other. In contrast, if the total projected area is larger than 50%, resin particles tend to fall off in a salient amount.

By the term "projected area" used herein we mean the area projected on a photograph as taken when the skin-contacting surface of the inner covering layer of a rubber glove is observed by a scanning electron microscope. The projected area ratio can be determined by automatically measuring the total projected area of resin particles having a maximum diameter in the range of 2 to 20 $\mu$m, which particles occur within a square unit area of 100 $\mu$m×100 $\mu$m and are not in contact with the peripheral boundary of the square unit area, by image-processing the resin particles by an image analyzing system ("Nexus 9000" available from K.K. Nexus).

The projected area ratio of resin particles can be controlled by the volume average particle diameter of resin particles, volume average particle diameter distribution thereof and amount thereof, and the thickness of the inner covering layer, and other factors.

Considerations should preferably be given for the following characteristics for controlling the projected area ratio within the above-mentioned range.

The ratio of the thickness of the inner covering layer to the volume average particle diameter of resin particles is preferably in the range of 0.2 to 2. If this ratio is larger than 2, the greater part of resin particles is buried within the inner covering layer and only a minor amount of resin particles is exposed on the skin-contacting surface of the inner covering layer, and thus, the benefits brought by resin particles are not obtained. In contrast, if this ratio is smaller than 0.2, the greater part of resin particles is exposed on the skin-contacting surface of the inner covering layer, and thus, the benefits brought by resin particles are obtained, but the adherence of resin particles to the inner covering layer is insufficient and the resin particles are liable to fall off.

The surface configuration index S of the skin-contacting surface of the inner covering layer, as defined by the following formula (2), is preferably in the range of 50 to 200, more preferably in the range of 60 to 150, and especially preferably 70 to 130. When the surface configuration index S is within this range, a rubber glove having good and well balanced properties can be obtained.

Surface configuration index $S=D(\mu m)\times A(\%)$ (2) wherein D is weight average particle diameter ($\mu$m) of resin particles as expressed by the weight average value of the maximum particle diameters of resin particles visually observed in unit area of the skin-contacting surface of the inner covering layer; and A is total projected area ratio as defined above by the formula (1).

The weight average particle diameter of resin particles can be automatically determined from the maximum diameters of resin particles occurring within a square unit area of 100 $\mu$m×100 $\mu$m and are not in contact with the peripheral boundary of the square unit area, by image-processing the resin particles by an image analyzing system ("Nexus 9000" available from K.K. Nexus).

The invention will now be specifically described by the following working examples that by no means limit the scope of the invention. In the working examples, % and parts are % by weight and parts by weight, respectively, unless otherwise specified. Weight of a polymer latex and weight of a coating composition are expressed by the weight of a solid content.

Properties of resin particles, an inner covering layer and a glove were determined by the following methods.

(1) Volume Average Particle Diameter ($\mu$m)

The volume average particle diameter of resin particles is measured by a Coulter LS230 (particle size analyzer available from Coulter Co.).

(2) Glass Transition Temperature (° C.)

An aqueous polymer dispersion is cast on a glass plate having frames at the peripheral edges. The cast polymer dispersion is pre-dried at 20° C. and then dried in an oven maintained at 130° C. for 30 minutes to form a polymer film. The glass transition temperature of the polymer film is measured by using a differential scanning calorimeter (DSC; "SSC 5200" available from Seiko Instruments Inc.) at an initiation temperature of −100° C. and a temperature elevation rate of 20° C./min.

(3) Content of Toluene Insoluble Matter (%)

0.5 g of the same film specimen as prepared for the measurement of glass transition temperature is weighed and dipped in 50 ml of toluene for 48 hours. Thereafter the solution is filtered by a wire mesh with a size of 100 mesh. The content (%) of toluene insoluble matter is expressed by the ratio by weight of the residual solid on the wire mesh to the weight of the film specimen.

(4) Projected Area Ratio (%) and Surface Configuration Index of Resin Particles

A flat square portion having a size of about 7 mm×about 7 mm is cut from a palm portion of a rubber glove having an inner rubber layer. The cut specimen is stuck on a measurement holder so that the inner covering layer of the glove is outwardly exposed.

The exposed surface of the stuck inner covering layer is coated with platinum at a thickness of 10 nm by using an ion coater ("QUICK AUTO COATER SC-704AT" available from Sanyu Denshi K.K.). A photograph is taken by a scanning electron microscope ("JSM-T300" available from JEOL Ltd.) at an accelerating voltage of 15 kV and 750× magnification.

The photograph is subjected to image-processing by an image analyzing system ("Nexus 9000" available from K.K. Nexus) to measure the total projected area B of resin particles with a maximum particle diameter of 2 to 20 μm, and the weight average particle diameter C (μm) of the resin particles exposed on the inner covering layer. The projected area ratio and the surface configuration index are calculated according to the above-mentioned formulae (1) and (2), respectively.

(5) Thickness of Inner Covering Layer (μm)

A flat portion is cut from a palm portion of a rubber glove having an inner rubber layer. The cut flat portion is cut in a direction perpendicular to the flat plane, and the perpendicularly cut portion is stuck on a measurement holder so that the perpendicularly cut section is upwardly exposed.

The upwardly exposed section of the stuck portion is coated with platinum at a thickness of 10 nm by using an ion coater ("QUICK AUTO COATER SC-704AT" available from Sanyu Denshi K. K.). A photograph is taken by a scanning electron microscope ("JSM-T300" available from JEOL Ltd.) at an accelerating voltage of 15 kV and 1,000× to 5,000×magnification.

The thickness of the cut flat portion is measured on a point at which the cut flat portion is predominantly comprised of a polymer latex and at which resin particles are not exposed on the skin-contacting surface of the cut flat portion. The measurement of thickness is conducted on twenty points, and the thickness of an inner covering layer is expressed by the average value of thickness.

(6) Ease in Donning and Putting off Rubber Glove

A rubber glove is put on and then put off in a state such that the inner surface is dry, and ease of donning and putting off the dry rubber glove is evaluated (dry donning and putting-off property). Further, a rubber glove is filled with water and then water is removed, and the thus-wetted glove is put on and then put off in a wet state. Ease of putting on and putting off the wet rubber glove is evaluated (wet donning and putting-off property). The evaluation results are expressed by the following three ratings.

Rating A: Donning and putting-off can be performed smoothly.

Rating B: Donning and putting-off can be performed with some difficulty.

Rating C: Donning and putting-off are accompanied by difficulty.

(7) Falling Off of Resin Particles

Only outer face of a rubber glove having an inner cover layer having resin particles partially exposed on the surface is washed with water in clean room, and then dried in an oven maintained at 40° C. Thereafter the dried glove is turned over to prepare a rubber glove specimen having the outwardly exposed inner covering layer with partially exposed resin particles.

The rubber glove specimen is placed within a clean polyethylene bag, and the bag is strongly crumpled twenty times. Then air within the clean room is introduced into the bag and the bag is closed. The bag is shaken ten times, and the number of resin particles fallen off from the rubber glove is counted by a particle number measuring device "KM-08" available from Rion Co. Ltd.

(8) Mutual Sticking of Inner Covering Layer

A load of 9.8 kPa is imposed from outside onto a rubber glove having an inner covering layer whereby the inner covering layer is pressed against each other. The loaded glove is left standing for 24 hours in a thermo-hygrostat maintained at a temperature of 40° C. and a relative humidity of 95%. Thereafter the rubber glove is taken out, and the folded and contacted portions of the inner covering layer are pulled to peel from each other. Ease of peeling is evaluated and expressed by the following three ratings.

Rating A: Peeling is easily performed

Rating B: Large peel-strength is required

Rating C: Peeling cannot be attained

REFERENCE EXAMPLE 1

Preparation of Polymer Latex

A pressure-resistant reaction vessel equipped with a stirrer was charged with 90 parts of deionized water, and then, a monomer mixture comprising 55 parts of butyl acrylate, 44 parts of methyl methacrylate and 1 part of methacrylic acid, and 5 parts of polyvinyl alcohol having a polymerization degree of 2,400 and a saponification degree of 88% were added with stirring to prepare a monomer emulsion.

Another pressure-resistant reaction vessel equipped with a stirrer, which temperature was controllable, was charged with 57 parts of deionized water and 8 parts of ethanol, and the temperature of the content was elevated to 80° C. While the content was maintained at 80° C., an aqueous initiator solution comprising 0.5 part of ammonium persulfate dissolved in 10 parts of deionized water was added to the content. When two minutes elapsed, addition of the above-mentioned monomer emulsion to the aqueous initiator solution was commenced. The monomer addition was continued over a period of 4 hours while being stirred. After completion of the addition of monomer emulsion, the reaction mixture was further stirred for 2 hours, and then cooled to terminate polymerization. The as-obtained polymer latex had a particle diameter of 0.35 μm. Polymerization conversion was 97%. Thereafter unreacted monomers were removed and a polymer latex having a solid content of 30% was obtained.

A portion of the polymer latex was coagulated to obtain a solid copolymer. The copolymer had a glass transition temperature of −3° C.

REFERENCE EXAMPLE 2

Preparation of Resin Particles A

To 200 parts of deionized water, 2 parts of polyvinyl alcohol having a polymerization degree of 800 and a saponification degree of 88% was dissolved. To the thus-prepared solution, 80 parts of styrene, 19.7 parts of butyl acrylate, 1.0 part of t-dodecyl mercaptan, 0.3 part of divinylbenzene and 5.0 parts of benzoyl peroxide (BPO) were added, and the mixture was homogenized to obtain a fine suspension.

A temperature-controllable reaction vessel equipped with a stirrer was charged with the fine suspension, and the content was flashed with nitrogen. The temperature of the content was elevated to 90° C. to commence polymerization. When 6 hours elapsed, the reaction mixture was cooled to terminate the polymerization. Polymerization conversion was 97%. The as-obtained polymer had a volume average particle diameter of 5.1 μm. An unreacted monomer was removed and an aqueous dispersion of copolymer resin particles A having a solid content of 30% was obtained.

The copolymer constituting resin particles A had a glass transition temperature of 55° C. and the content of toluene insoluble matter was 3%.

REFERENCE EXAMPLE 3 to 5

Preparation of Resin Particles B, C and D

By the same procedures as described in Reference Example 2, resin particles B, C and D were prepared wherein the monomer composition, and the amounts of dispersion stabilizer, t-dodecyl mercaptan and benzoyl peroxide were varied as shown in Table 1. All other conditions remained the same.

TABLE 1

| | Reference Example No. | | | |
|---|---|---|---|---|
| | 2 | 3 | 4 | 5 |
| | Resin particles | | | |
| | A | B | C | D |
| Amounts (parts) | | | | |
| Deionized water | 200 | 200 | 200 | 200 |
| Styrene | 80 | 80 | 80 | — |
| Methyl methacrylate | — | — | — | 96 |
| Butyl acrylate | 19.7 | 19.5 | 19.7 | 3.7 |
| Divinylbenzene | 0.3 | 0.5 | 0.3 | 0.3 |
| t-Dodecyl mercaptan | 1 | 0.75 | 1 | 1 |
| Polyvinyl alcohol | 2 | 1 | 10 | 5 |
| BPO | 5 | 3 | 3 | 2 |
| Stirring condtions | | | | |
| No. of revolution (rpm) | 250 | 250 | 250 | 250 |
| Properties of resin particles | | | | |
| Volume average particle diameter (μm) | 5.1 | 6.5 | 0.5 | 2.8 |
| Glass transition temperature (° C.) | 55 | 55 | 55 | 95 |
| Amount of toluene insoluble matter (%) | 3 | 42 | 3 | 10 |

EXAMPLE 1

100 parts (as solid content) of resin particles A in the form of an aqueous dispersion having a solid content of 30% prepared in Reference Example 2, and 100 parts (as solid content) of polymer latex having a solid content of 30% prepared in Reference Example 1 were mixed together. The mixture was diluted with deionized water to prepare a coating composition having a solid content of 10% and a viscosity of 10 Pa·S.

10 parts of sulfur, 15 parts of zinc oxide, 7 parts of titanium oxide, 0.3 part of potassium hydroxide, and 32 parts of water were mixed together to prepare a vulcanizer solution having a solid content of 50.2%. 7 parts by weight of the vulcanizer solution was mixed with 333 parts of dip forming NBR latex having a solid content of 30% to prepare a dip forming formulation having a solid content of 30.4%.

20 parts of calcium nitrate, 0.05 part of polyoxyethylene octyl-phenyl-ether (nonionic surface active agent) and 80 parts of deionized water were mixed together to prepare a coagulant solution having a solid content of 20.4%. A glove form was dipped in the coagulant solution for 1 minute, and then taken out therefrom. The coagulant-applied glove form was dried at 50° C. for 3 minutes thereby to deposit the coagulant on the glove form.

The coagulant-deposited glove form was dipped in the above-mentioned dip forming NBR latex formulation for 10 seconds, and then taken out. The dip forming formulation-applied glove form was dried at 60° C. for 5 minutes, and then dipped in warm water maintained at 50° C. for 5 minutes. Thereafter the glove form was taken out and dried at 60° C. for 5 minutes to give a glove form having an NBR layer.

The glove form having an NBR layer was dipped in the above-mentioned coating composition for 10 seconds, and then taken out. The coating composition-applied glove form was dried at 70° C. for 10 minutes and further heat-treated at 120° C. for 25 minutes to give a glove form having an outer solid composite rubber film. The outer solid composite rubber film was stripped from the glove form, while the solid composite rubber film was reversed to place the first deposited NBR layer on the outer surface of the reversed composite rubber film. Thus a rubber glove having a main NBR layer and an inner covering layer, bonded to the main NBR layer, was obtained, which inner covering layer contained resin particles partially exposed on the skin-contacting surface thereof.

The projected area ratio of resin particles occurring on the skin-contacting surface of the inner covering layer having a maximum particle diameter in the range of 2 to 20 μm was 15%. The resin particles, visually observed in unit area of the skin-contacting surface area, had a weight average particle diameter of 5.2 μm. The inner covering layer had a thickness of 2 μm. The properties of the rubber glove were evaluated. The results are shown in Table 2.

EXAMPLES 2 to 7, COMPARATIVE EXAMPLES 1 to 4

By the same procedures as described in Example 1, rubber gloves were manufactured wherein the kind and amount of resin particles were varied as shown in Table 2. All other conditions remained substantially the same.

In Comparative Example 3, a coating composition having a solid content of 50% was used, which was prepared by mixing together an aqueous dispersion of resin particles A prepared in Reference Example 2 with polymer latex prepared in Reference Example 1, and then distilling off water from the mixture to adjust the concentration to 50%.

Projected area ratio and weight average particle diameter of resin particles on the skin-contacting surface of each inner covering layer, and thickness of the inner covering layer were measured, and properties of rubber gloves were evaluated. The results are shown in Table 2.

TABLE 2

| | Examples | | | | | | | Comparative Examples | | | |
|---|---|---|---|---|---|---|---|---|---|---|---|
| | 1 | 2 | 3 | 4 | 5 | 6 | 7 | 1 | 2 | 3 | 4 |
| Amount of polymer latex (parts) | 100 | 100 | 100 | 100 | 100 | 100 | 100 | 100 | 100 | 100 | 100 |
| Resin particles | A | A | A | B | B | D | D | A | B | A | C |
| Amount (parts) | 100 | 150 | 200 | 100 | 40 | 125 | 150 | 10 | 500 | 100 | 100 |
| Solid content in coating composition (%) | 10 | 10 | 10 | 10 | 10 | 10 | 10 | 10 | 10 | 50 | 10 |
| Viscosity of coating composition (mPa.s) | 10 | 5 | 4 | 10 | 20 | 9 | 5 | 40 | 10 | 1800 | 10 |
| Thickness of inner covering layer (μm) | 2 | 2 | 1.5 | 2 | 2.5 | 2 | 2 | 3.5 | 0.5 | 20 | 2 |

TABLE 2-continued

| | Examples | | | | | | | Comparative Examples | | | |
|---|---|---|---|---|---|---|---|---|---|---|---|
| | 1 | 2 | 3 | 4 | 5 | 6 | 7 | 1 | 2 | 3 | 4 |
| Resin particles | | | | | | | | | | | |
| Weight average particle diameter (μm)*1 | 5.2 | 5.1 | 5.1 | 6.5 | 6.6 | 2.9 | 2.8 | 5.3 | 6.5 | 3.8 | 0.9 |
| Projected area ratio A (%) | 15 | 20 | 27 | 16 | 9 | 30 | 37 | 4 | 55 | 3 | 4 |
| Surface configuration index S | 78 | 102 | 138 | 104 | 59.4 | 87 | 104 | 21 | 358 | 11 | 4 |
| Thickness of inner covering layer (μm) /volume average particle diameter (μm) | 0.39 | 0.39 | 0.29 | 0.31 | 0.38 | 1.4 | 1.4 | 0.69 | 0.08 | 3.9 | 4 |
| Properties of rubber glove | | | | | | | | | | | |
| Dry donning and putting-off property | A | A | A | A | A | A | A | C | A | C | C |
| Wet donning and putting-off property | A | A | A | A | A | A | A | B | A | B | C |
| Resin particles falling-off property | 1150 | 1230 | 2300 | 850 | 320 | 500 | 700 | 150 | 16700 | 450 | 670 |
| Mutual sticking of inner covering layer | A | A | A | A | B | A | A | C | A | C | C |

*1:Weight average particle diameter (μm) of resin particles occurring on inner covering layer surface.

As seen from Table 2, when the projected area ratio A of resin particles occurring on the surface of the inner covering layer and having a maximum diameter of 2 to 20 μm is smaller than the range claimed in the present invention (Comparative Examples 1, 3 and 4), the inner covering layer tends to stick to each other and the glove is difficult to don and put-off. When the projected area ratio A of resin particles occurring on the surface of the inner covering layer and having a maximum diameter of 2 to 20 μm is larger than the range claimed in the present invention (Comparative Example 2), resin particles are liable to fall off in a salient amount.

In contrast, when the projected area ratio A of resin particles with a maximum diameter of 2 to 20 μm occurring in unit area of 100 μm×100 μm is within the range of 5 to 50% (Examples 1 to 7), the glove can be easily donned and pulled off, and resin particles do not fall or do fall off only to a very slight extent when the glove is donned or pulled off, and, when the inner covering layer is placed in contact with each other, the layer does not easily stick to each other.

What is claimed is:

1. A rubber glove comprising a main rubber layer and an inner covering layer, bonded to the main rubber layer, said inner covering layer being formed from a coating composition comprising a polymer latex and resin particles dispersed in the polymer latex; said resin particles being partially exposed on the skin-contacting surface of the inner covering layer to an extent such that, among resin particles visually observed in unit area of the skin-contacting surface of the inner covering layer, resin particles having a maximum particle diameter in the range of 2 to 20 μm have a total projected area ratio A in the range of 5% to 50%, as defined by the following formula (1):

Total projected area ratio A(%)=B/C×100 (1)

where B is total projected area of the resin particles with a maximum particle diameter of 2 to 20 μm, and C is the unit area.

2. The rubber glove according to claim 1, wherein the resin particles have a surface configuration index S, as defined by the following formula (2), of 50 to 200:

Surface configuration index S=D(μm)×A(%) (2)

wherein D is weight average particle diameter (μm) of resin particles as expressed by the weight average value of the maximum particle diameters of resin particles visually observed in unit area of the skin-contacting surface of the inner covering layer; and A is total projected area ratio as defined above by the formula (1).

3. The rubber glove according to claim 1, wherein the inner covering layer has a thickness in the range of 0.1 to 10 μm.

4. The rubber glove according to claim 1, wherein the amount of the resin particles in the coating composition is in the range of 20 to 300 parts by weight based on 100 parts by weight of the solid content of the polymer latex.

5. The rubber glove according to claim 1, wherein the resin particles in the coating composition has a volume average particle diameter in the range of 1 to 50 μm.

6. The rubber glove according to claim 1, wherein the ratio of thickness of the inner covering layer to volume average particle diameter of the resin particles in the coating composition is in the range of 0.2 to 2.

7. The rubber glove according to claim 1, wherein the resin particles in the coating composition have a glass transition temperature in the range of 30 to 120° C.

8. The rubber glove according to claim 1, wherein the resin particles contains 0 to 60% by weight of toluene-insoluble matter.

9. The rubber glove according to claim 1, wherein the polymer latex in the coating composition comprises at least one polymer selected from the group consisting of a styrene-butadiene copolymer, an acrylonitrile-butadiene copolymer, an acrylic acid ester copolymer and a methacrylic acid ester copolymer, which polymer is dispersion-stabilized with a water-soluble polymeric material; and the resin particles in the coating composition contain 0 to 60% by weight of toluene-insoluble matter, and comprise resin particles of at least one polymer selected from the group consisting of an acrylic acid ester polymer, a methacrylic acid ester polymer, a styrene-acrylic acid ester copolymer and a styrene-methacrylic acid ester copolymer, polyurethane, polyamide, an olefin polymer, a vinyl chloride polymer, a vinylidene chloride polymer and cellulose derivatives.

10. A process for producing a rubber glove comprising a main rubber layer and an inner covering layer, bonded to the main rubber layer, which comprises the step of:

coating one surface of a rubber glove having a main rubber layer, with a coating composition comprising a polymer latex and resin particles dispersed in the polymer latex, to form a resin particle-containing inner covering layer on the surface of the rubber glove; the thus-formed inner covering layer having resin particles, which are partially exposed on the skin-contacting surface of the inner covering layer to an extent such that, among resin particles visually observed in unit area of the skin-contacting surface of the inner covering layer, resin particles having a maximum particle diameter in the range of 2 to 20 μm have a total projected area ratio A in the range of 5% to 50%, as defined by the following formula (1):

Total projected area ratio A(%)=B/C×100 (1)

where B is total projected area of the resin particles with a maximum particle diameter of 2 to 20 μm, and C is the unit area.

* * * * *